United States Patent [19]

Cohen

[11] 4,234,083

[45] Nov. 18, 1980

[54] MIXING AND FILTERING VIAL

[76] Inventor: Milton J. Cohen, 10823 Burbank Dr., Potomac, Md. 20854

[21] Appl. No.: 93,759

[22] Filed: Nov. 13, 1979

[51] Int. Cl.[3] ..... B65D 25/08

[52] U.S. Cl. ..... 206/221; 215/DIG. 8; 128/272.1

[58] Field of Search ..... 206/219, 220, 221; 215/DIG. 8; 128/272.1

[56] References Cited

U.S. PATENT DOCUMENTS

| | | | |
|---|---|---|---|
| 3,733,179 | 5/1973 | Guehler | 206/219 X |
| 4,055,177 | 10/1977 | Cohen | 128/218 M |
| 4,122,943 | 10/1978 | Silver et al. | 206/221 |
| 4,153,057 | 5/1979 | Kobel | 128/272.1 |

*Primary Examiner*—Joseph Man-Fu Moy

*Attorney, Agent, or Firm*—McDougall, Hersh & Scott

[57] ABSTRACT

A device for packaging ingredients, one of which is in the liquid phase, in a separated relation until mixed and extracted under sterile conditions by filtration of air introduced into the device and filtration of the mixture when extracted from the device.

6 Claims, 3 Drawing Figures

MIXING AND FILTERING VIAL

Figure 1:
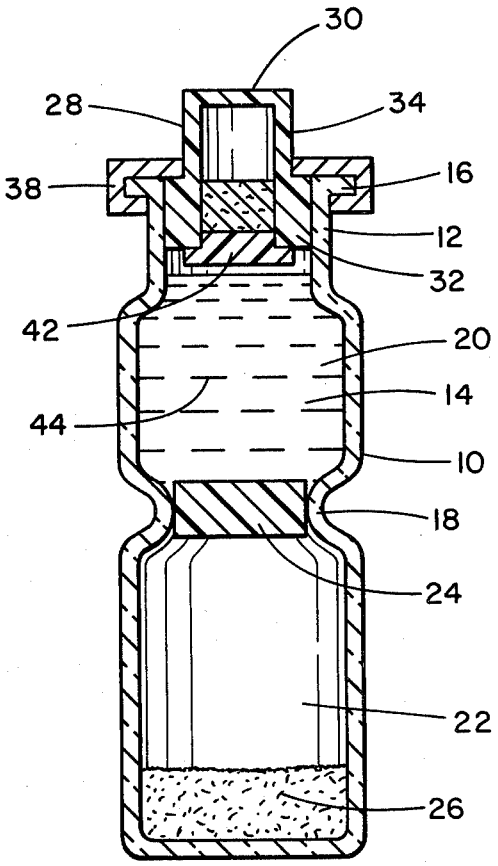

This invention relates to a device for injection of a solution of two or more components admixed immediately prior to injection.

The invention is addressed to the administration of materials, such as medicaments, which cannot be premixed without deterioration, loss of activity or the like, such that admixture in the measured amounts is required to be made immediately prior to use, as by injection. Weighing out the required amounts from bulk containers for admixture immediately prior to use is a time consuming operation which is subject to considerable error and which exposes the materials to possible contamination.

More recently, the art has turned to injection devices wherein the materials, in measured amounts, are contained in separated compartments with means for combining the materials in a single compartment immediately prior to use for injection of the solution or dispersion that is formed without exposure to elements which might otherwise cause contamination. Reference is made to my previously issued U.S. Pat. No. 3,557,787; U.S. Pat. No. 3,678,931; U.S. Pat. No. 3,682,174; U.S. Pat. No. 3,757,779; U.S. Pat. No. 3,779,371; U.S. Pat. No. 3,785,397; U.S. Pat. No. 3,838,689; and U.S. Pat. No. 4,055,177.

In each of my previously issued patents, except for U.S. Pat. No. 4,055,177, use is made of a pair of telescoping vials sealably separated one from the other in which a liquid component is contained in one and a powdered or liquid component is contained in the other for solution or dispersion in the liquid component which is transferred from the one to the other vial immediately prior to use, such as in response to displacement of a piston plug within the one vial. The other vial is usually provided with a hollow needle for dispensing the solution or dispersion in response to displacement of the one vial within the other as a piston plug.

In the more recently issued U.S. Pat. No. 4,055,177, the concept is reduced to a single vial which is subdivided by a sealing disc into an upper compartment and a lower compartment, in which the liquid component in a measured amount is maintained in the upper compartment separated in sealed relation from the dry solid or liquid in the lower compartment. The sealing disc is adapted to be pierced by a hollow needle projecting from the lower compartment in response to displacement of a piston plug in the upper compartment whereby the liquid is transferred from the upper compartment to the lower compartment in response to continued displacement of the piston plug. As in the previous construction, the lower compartment is provided with a hollow needle to enable displacement of the mixture therefrom for dispensing in response to continued movement of the piston plug through the vial.

It is an object of this invention to introduce a new and improved concept for maintaining a sealed relation between compartments within a single vial with means for dispensing with the sealed relation to enable admixture of the materials from the previously separated compartments whereby the measured amounts of materials can be combined in their entirety for admixing one with the other immediately prior to use. The device also embodies means for removal of particulates that may remain after the combined materials are dispensed from the vial to a syringe for injection or otherwise.

Figure 2:
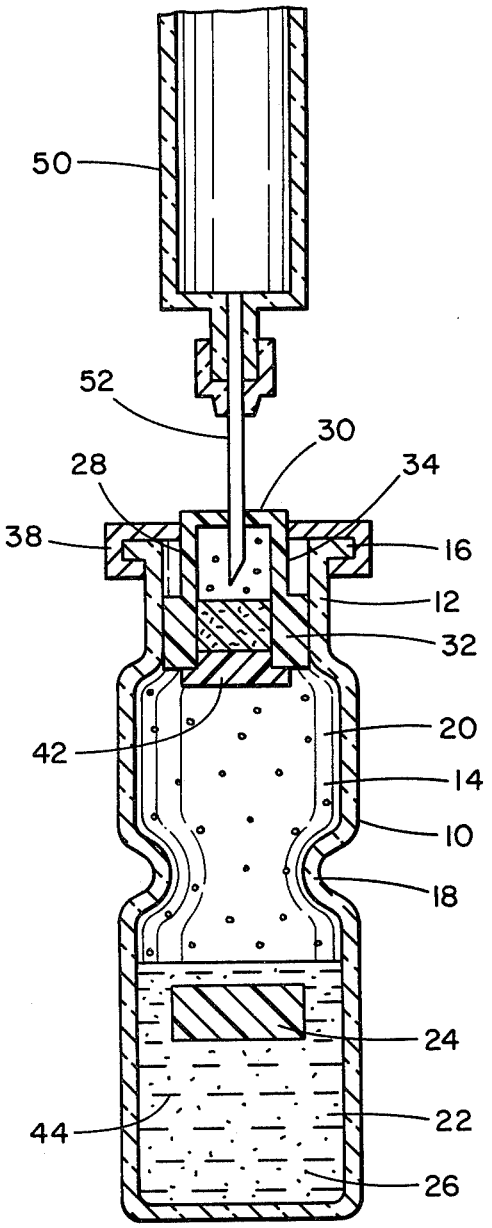
Figure 3:
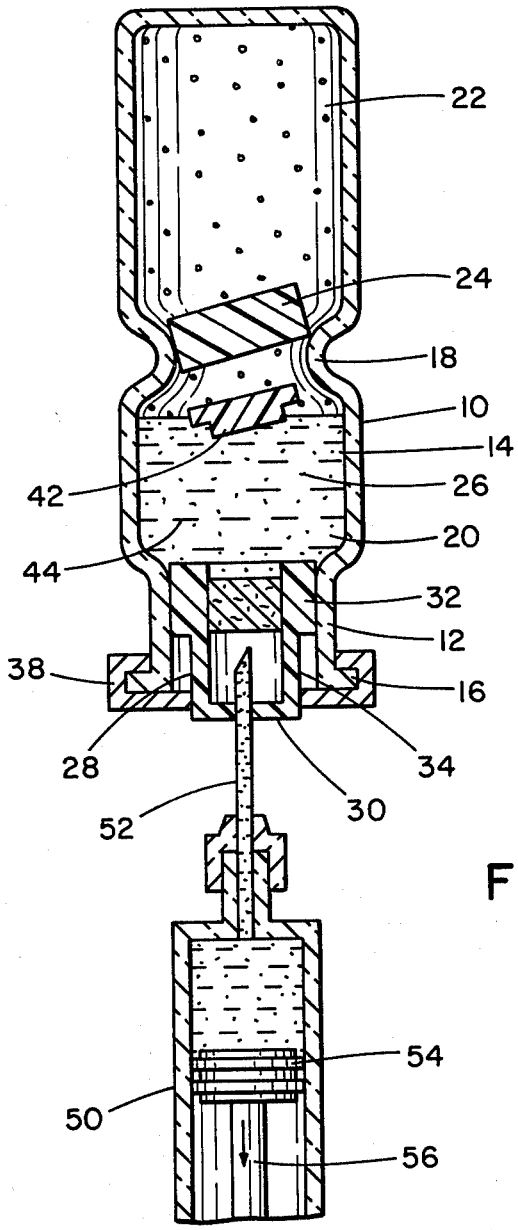

These and other objects and advantages of this invention will hereinafter appear and, for purposes of illustration but not of limitation, an embodiment of the invention is shown in the accompanying drawings in which:

FIG. 1 is a schematic sectional elevational view of a device embodying the features of this invention, shown in its assembled relation for packaging;

FIG. 2 is a schematic sectional elevational view of the device shown in FIG. 1, illustrating the arrangement of parts during an intermediate stage wherein the materials are released for admixture one with the other in the vial; and FIG. 3 is a sectional elevational view of the device shown in FIGS. 1 and 2, illustrating the arrangement of parts during dispensing of the mixture from the vial to a syringe for subsequent injection or use.

The device embodying the features of this invention comprise a vial 10 of glass, plastic or other fluid and vapor impervious material which is open at one end, as defined by an elongate neck portion 12 of relatively uniform cross section but of lesser dimension than the body portion 14 of the vial and which terminates in an annular lip portion 16. A restriction 18, as in a vial of hour glass shape, is provided in an intermediate section of the vial to define an upper compartment 20 and a lower compartment 22 on opposite sides of the constricted portion 18. A separating member in the form of a disc member 24 having a diameter corresponding to the diameter at the portion of greatest restriction, is adapted to be engaged between the restricted portion for sealing engagement therewith to seal off the upper compartment 20 from the lower compartment 22. The measured increment of solid or fluid material 26 is introduced into the lower compartment 22 before the sealing disc 24 is positioned to seal off the lower compartment from the upper compartment.

The open upper end of the vial is adapted to be sealed by a hollow plunger 28 in the form of an inverted tubular member, the upper wall 30 of which is formed of a rupturable material. The outer wall to wall dimension of the lower portion 32 of the tubular member 28 is adapted to correspond with the inner wall to wall dimension of the neck portion 12 of the vial but less than the body portion 14 of the vial, whereby the tubular member is slideably received within the neck portion of the vial, in sealing engagement to plug the opening while being axially slideable relative thereto. The outer wall to wall dimension of the upper portion 34 of the tubular member 28 is of lesser dimension than the lower portion 32 to provide an annular abutment 36 whereby a crimping cap 38, extending about the lip portion 16 and over the annular abutment 36 is effective to maintain the tubular member 28 in the assembled relation for sealing the open end of the vial.

A filter element 40, in the form of a filter disc, is secured in sealing relation within the interior of the hollow tubular member 28 for filtering any fluid or gas passing through the tubular member. Such filter means may comprise a paper filter or other fine filter such as formed of metal wires, glass fibers or the like for biological use. A removable stopper 42, such as a rubber plug, is dimensioned to be received in the open end of the tubular member 28 for sealing the tubular member and separating the filter from the interior of the vial 10.

The upper compartment 14 of the vial is filled with a measured amount of a liquid component 44 before the tubular member, pre-assembled with the filter and stopper, is inserted into the neck portion of the vial and secured therein by the crimp cap 38.

The described assembly, as illustrated in FIG. 1, comprises the device of this invention wherein the components are confined within separated compartments, and in measured amounts, for packaging, storage and/or shipment to stations of use. The neck portion with the assembled tubular member may be protected with a cover (not shown) if desired.

In use, the separating disc 24 is first inactivated by displacement from between the restricted portion 18 of the vial in response to displacement of the tubular member 28 inwardly into the vial. This can be simply accomplished by pressing with the finger on the portion of the tubular member 28 projecting beyond the end of the vial whereby the tubular member acts as a plunger to place pressure on the fluid 44 (liquid or liquid and gas), filling the upper compartment as it is displaced downwardly with the result that the separating disc 24 is displaced from between the restricted portion in response to the liquid pressure.

Thus communication is established between the two compartments 20 and 22 through the restricted portion 18 to make the measured amount of material in both compartments available for admixture one with the other. Such mixing by agitation can be continued, if desired, as for an extended period of time for complete solution without affecting the sealed relation which is retained by the portion of the plunger remaining in the neck of the vial.

When it is desired to extract the combined materials, preferably as solution, as by means of a syringe 50 to be used in subsequent dispensing, as by injection, the hollow needle 52 of the syringe 50 is projected through the top wall 30 of the hollow tubular member 28 to position the end of the needle in the void space immediately above the filter member 40. Responsive to the downward displacement of the piston plug 54 in the syringe 50, as by means of the plunger 56, air or gas in the syringe is forced from the syringe into the tubular member whereby the stopper 42 is unseated from the open end. Upon continued displacement of the piston plug, air or gas is forced from the syringe, into the tubular member, and through the filter 40 into the vial whereby the interior of the vial becomes pressurized with filtered air or gas. Both the stopper 42 and the sealing disc 24 fall freely in the solution contained under pressure within the vial, as illustrated in FIG. 3.

The solution is thereafter extracted from the vial into the syringe 50 by inverting the assembly whereby the air or gaseous phase is uppermost in the vial 10 while the liquid solution is lowermost in contact with the filter means confined in the tubular member. In response to the withdrawal of the plunger 56 for displacement of the piston plug in the syringe, and with the aid of the positive pressure provided by the filtered air in the vial, the liquid is caused to flow from the vial into the tubular member 28 and through the filter disc 40 and the needle 52 into the syringe. When the desired increment has been removed, the needle can be withdrawn to enable the removed liquid to be dispensed from the syringe, as by injection, in the normal manner.

It will be apparent from the foregoing that means are provided for packaging ingredients which require separation until immediately prior to use and in which admixture can be effected for removal of the mixed ingredients while maintaining sterile conditions. The device embodying the features of this invention also includes filter means as a part thereof to filter air or other gas introduced into the unit and to filter solution withdrawn from the unit thereby to eliminate the need to provide filter means in the syringe or other injection device often heretofore required in the injection of medicaments.

It will be understood that changes may be made in the details of construction, arrangement and operation, without departing from the spirit of the invention, especially as defined in the following claims.

I claim:

1. A device for packaging at least two materials which are to be maintained in a separated relation until admixed immediately prior to removal, one of the materials being in a liquid phase, comprising a vial open at one end and having an intermediate restricted portion, a sealing member secured in sealing relation across the restricted portion to sub-divide the vial into an upper compartment in communication with the open end and a lower compartment, with the material in the liquid phase disposed in the upper compartment and with the other material in the lower compartment, a tubular member open at the bottom and closed at the top, said tubular member into the open end portion of the vial to seal the vial with a portion of the tubular member projecting beyond the open end of the vial, a filter member disposed within the tubular member for filtering fluids passing through the tubular member, and a stopper seated in the open end of the tubular member.

2. A device as claimed in claim 1 in which the vial is of hour glass shape.

3. A device as claimed in claim 1 in which the sealing member is a sealing disc dimensioned to correspond to the restricted portion of the vial but less than the unrestricted portion of the vial whereby the sealing disc can be unseated for displacement from the restricted portion to provide communication between the compartments.

4. A device as claimed in claim 1 in which the vial has an annular lip extending outwardly from the open end and in which the portion of the tubular member extending beyond the open end of the vial is of lesser cross section than the portion inserted into the open end of the vial to provide an abutment level with the lip portion of the vial, and a crimp cap embracing the lip portion of the vial and extending onto the abutment of the tubular member to secure the tubular member in the assembled relation in the vial.

5. A device as claimed in claim 1 in which the filter member comprises a filter disc seated in sealing engagement within the tubular member.

6. A device as claimed in claim 1 in which the tubular member is closed by a top wall formed of a penetratable material to enable a syringe needle to be inserted through the top wall into the tubular member.

* * * * *